US010160109B2

(12) United States Patent
Goepfert et al.

(10) Patent No.: US 10,160,109 B2
(45) Date of Patent: Dec. 25, 2018

(54) PYROTECHNIC DRIVING DEVICE

(71) Applicant: Hilti Aktiengesellschaft, Schaan (LI)

(72) Inventors: Peter Goepfert, Aeugst am Albis (CH); Peter Roth, Grabs (CH); Orestis Voulkidis, Buchs (CH); Julian Keller, Mauren (LI); Matthias Blessing, Frastanz (AT)

(73) Assignee: Hilti Aktiengesellschaft, Schaan (LI)

( * ) Notice: Subject to any disclaimer, the term of this patent is extended or adjusted under 35 U.S.C. 154(b) by 406 days.

(21) Appl. No.: 15/038,076

(22) PCT Filed: Nov. 25, 2014

(86) PCT No.: PCT/EP2014/075463
§ 371 (c)(1),
(2) Date: May 20, 2016

(87) PCT Pub. No.: WO2015/078833
PCT Pub. Date: Jun. 4, 2015

(65) Prior Publication Data

US 2016/0303725 A1 Oct. 20, 2016

(30) Foreign Application Priority Data

Nov. 26, 2013 (EP) ..... 13194459

(51) Int. Cl.
*B25C 1/14* (2006.01)
*B25C 1/10* (2006.01)

(52) U.S. Cl.
CPC . *B25C 1/14* (2013.01); *B25C 1/10* (2013.01)

(58) Field of Classification Search
CPC ... B25C 1/08; B25C 1/143; B25D 2217/0084; B25D 2250/121

(Continued)

(56) References Cited

U.S. PATENT DOCUMENTS 3,659,768 A * 5/1972 Brunelle ..... B25C 1/082 227/10
3,888,079 A * 6/1975 Diesinger ..... F02K 9/28 60/245

(Continued)

FOREIGN PATENT DOCUMENTS

DE 1 99 62 584 C1 6/2001

OTHER PUBLICATIONS

European Patent Office, European Search Report in European Patent Application No. 13194459.7, dated Jun. 18, 2014.

(Continued)

*Primary Examiner* — Robert Long
(74) *Attorney, Agent, or Firm* — Leydig Voit & Mayer

(57) ABSTRACT

The invention relates to a driving device, comprising a hand-held housing having an energy transmission element accommodated therein for transmitting energy to a fastening element to be driven in, an exchangeable propellant charge and a combustion chamber arranged between the propellant charge and the energy transmission element, said combustion chamber extending about a central axis, wherein the combustion chamber is subdivided by means of a dividing member having a number of interruptions into a first subchamber adjoining the propellant charge and at least one second subchamber adjoining the energy transmission element, wherein an ejection region, enclosing a central axis, for the propellant charge is provided in the first subchamber, said ejection region extending between the propellant charge and a central region of the dividing member, wherein the ejection region is bounded at the central region of the dividing member by a closed surface of the dividing member.

20 Claims, 3 Drawing Sheets

(58) Field of Classification Search
USPC ..... 227/10, 130; 91/169, 217, 423, 442, 469
See application file for complete search history.

(56) References Cited

U.S. PATENT DOCUMENTS 3,891,036 A * 6/1975 Schmidt ..... E21B 4/145 173/137
3,981,424 A * 9/1976 Maier ..... B25C 1/085 227/10
4,403,722 A * 9/1983 Nikolich ..... B25C 1/008 227/10
4,483,473 A * 11/1984 Wagdy ..... F02P 11/04 123/46 SC
4,483,474 A * 11/1984 Nikolich ..... B25C 1/008 123/46 SC
4,913,331 A * 4/1990 Utsumi ..... B25C 1/08 227/10
6,148,610 A * 11/2000 Calabro ..... B64G 1/002 102/287
6,321,968 B1 11/2001 Remerowski
7,201,301 B2 * 4/2007 Moeller ..... B25C 1/08 123/46 SC
7,293,684 B1 * 11/2007 Wen ..... B25C 1/045 123/46 SC
2006/0225675 A1 * 10/2006 Nishikawa ..... B25C 1/08 123/46 H
2007/0075113 A1 * 4/2007 Tillinghast ..... B25C 1/008 227/130
2009/0230166 A1 * 9/2009 Yamamoto ..... B25C 1/042 227/130
2010/0065602 A1 * 3/2010 Zhao ..... B25C 1/08 227/9
2010/0258609 A1 * 10/2010 Lee ..... B25C 1/143 227/10
2010/0327039 A1 * 12/2010 Adams ..... B25C 1/08 227/9
2011/0079624 A1 * 4/2011 Oiwa ..... B25C 1/08 227/9
2012/0067935 A1 * 3/2012 Liu ..... B25C 1/047 227/10
2012/0145763 A1 * 6/2012 Dittrich ..... B25C 1/08 227/10
2015/0102084 A1 * 4/2015 Zhao ..... B25C 1/08 227/10
2016/0311098 A1 * 10/2016 Blessing ..... B25C 1/143

OTHER PUBLICATIONS

International Bureau, International Search Report in International Patent Application No. PCT/EP2014/075463, dated Feb. 27, 2015.

* cited by examiner

PYROTECHNIC DRIVING DEVICE

CROSS-REFERENCE TO RELATED APPLICATIONS

This patent application is the U.S. National Stage of International Patent Application No. PCT/EP2014/075463, filed Nov. 25, 2014, which claims the benefit of European Patent Application No. 13194459.7, filed Nov. 26, 2013, which are each incorporated by reference.

The invention relates to a driving device according to the preamble of Claim 1.

BACKGROUND OF THE INVENTION

Handheld driving devices comprising propellant charges are known from the prior art; in such devices the resulting combustion gases, following the ignition of a pyrotechnic charge, expand in a combustion chamber. Thereby a piston as an energy transmission means is accelerated and drives a fastening means into a workpiece. An optimized, residue-free and reproducible combustion of the charge is fundamentally desired. It must be considered in this regard that the charge generally comprises powder grains, fibers or the like, which are initially driven ahead of a flame front following an ignition.

U.S. Pat. No. 6,321,968 B1 describes a driving device having a propellant charge, in which the combustion chamber is separated by means of a perforated sieve into an upper partial chamber and a lower partial chamber. Before combustion, the powder grains are larger than the holes of the sieve. Therefore, unburnt powder grains are initially accelerated in a central discharge region toward the perforated regions of the separating disc, where they are held back due to the dimensioning of the holes in the separating disc such that the powder grains are largely combusted in the upper partial chamber. FIG. 10 shows a variation in which a propellant charge without a cartridge is used. Based on the design in this variant, a discharge region enclosing the central axis in the upper partial chamber and extending between the propellant charge and a central region of the separation disc is not provided. The discharge region in the example according to FIG. 10 is arranged in an annular manner about a central plunger of the combustion chamber. The cartridge-free charge is ignited at an upper end of the central plunger.

The problem addressed by the invention is that of specifying a driving device that enables a uniform and optimally complete combustion of a pyrotechnic propellant charge.

BRIEF SUMMARY OF THE INVENTION

This problem is solved for a driving device of the type mentioned above by the characterizing features of Claim 1. Due to the provision of the contiguous surface in the central region of the separating member, particles of the charge that are discharged into the combustion chamber after ignition are first reflected or deflected, regardless of their size, before they come into contact with one of the perforations. In this modified manner, the particles can distribute themselves uniformly in the upper partial chamber while they are caught by the flame front and likewise ignited.

An energy transmission element in keeping with the invention is any means to which kinetic energy is applied due to the ignition of the charge and ultimately transmitted to the fastening means. The energy transmission element is frequently constructed as a piston, particularly a rotationally symmetric piston. Cutouts and other structures that further facilitate turbulence and uniform expansion of the combustion gases can be provided in the piston base.

A fastening element in keeping with the invention is understood in general to be any drivable anchoring means such as a nail, bolt or screw.

A discharge region in keeping with the invention is a prismatic, usually cylindrical spatial region, the cross section of which is defined by a surface of the igniting charge directed into the combustion chamber and which extends perpendicular to the surface. If the propellant charge is provided in the form of a cartridge, the surface of the charge is defined here as the exit face of the opened cartridge. In this case, the discharge region is substantially cylindrical in shape. Its diameter corresponds substantially to the internal diameter of the cartridge.

A central axis in keeping with the invention runs as a center of gravity line through the discharge region. Ordinarily, but not necessarily, the central axis coincides with the movement axis of the energy transmission element.

A separating member in keeping with the invention is any structure by which the combustion chamber is divided into two partial chambers. The separating member preferably runs transverse to the central axis. It can be formed as a disc with multiple drilled holes, for example.

According to the invention, the central region of the separating member has a recess. A particularly good backscattering of the deflected particles and turbulence of the combustion gases in the first partial chamber can be accomplished by means of this recess.

The central region of the separating member is preferably not perforated, so that at least a considerable part of the initially discharged particles moves within the discharge region through the first combustion chamber toward the central region without first entering the second partial chamber through the separating member. The contiguous surface area of the central region is preferably larger than an intersection area of the separating member with the discharge region.

In a preferred refinement, the depression is constructed as a bowl-shaped recess in the separating member. This facilitates scattering and turbulence to a particular extent.

For further improvement of the scattering and turbulence, a projecting protrusion is formed in a central region of the recess in a preferred embodiment. The protrusion can be conical, for example.

Alternatively or additionally, it is provided that the recess has a diameter tapering downward, which likewise effects a good distribution of powder grains and combustion gases.

In the interest of an optimal effect of the depression on a large part of the propellant charge, it is preferably provided that the maximum diameter of the recess extending perpendicular to the central axis is not less than 80% of a maximum diameter of an opening of the propellant charge extending perpendicular to the axis. It is generally preferred if the diameter of the recess is greater than the diameter of the opening of the propellant charge.

In order to improve the turbulent effect of the recess, it is also preferably provided that a maximum depth of the recess as measured in the direction of the axis is not less than 30%, especially preferably not less than 50% of a maximum diameter of the recess measured perpendicular to the axis.

It is advantageous in general to provide a web between each two adjacent perforations, wherein the combustion gases of the propellant charge initially flow radially outward between the webs from the discharge region before they flow in the axial direction through the perforations after deflection. In this way, the deflection and turbulence of the combustion gases is further optimized, and undesired entry of large powder grains into the perforations is further reduced.

It is generally preferable that the perforations of the separating member have a cross section that is larger than a maximum cross section of particles in the propellant charge. This prevents clogging of the perforations with combustion residues. Due to the additional features of the invention, an entry of large powder grains into the second partial chamber is largely avoided, despite relatively large perforations.

In the interest of a simple assembly and maintenance, the separating member is preferably screwed into the combustion chamber by means of an external thread formed on the separating member. In alternative embodiments, the separating member is pressed, soldered, welded, glued or mounted in some other form-fitting manner in the combustion chamber.

Further features and advantages of the invention follow from the embodiments described below, and from the dependent claims. Several preferred embodiments of the invention will be described below and explained in detail with reference to the appended drawings.

BRIEF DESCRIPTION OF THE SEVERAL VIEWS OF THE DRAWING(S)

DETAILED DESCRIPTION OF THE INVENTION

Figure 1:
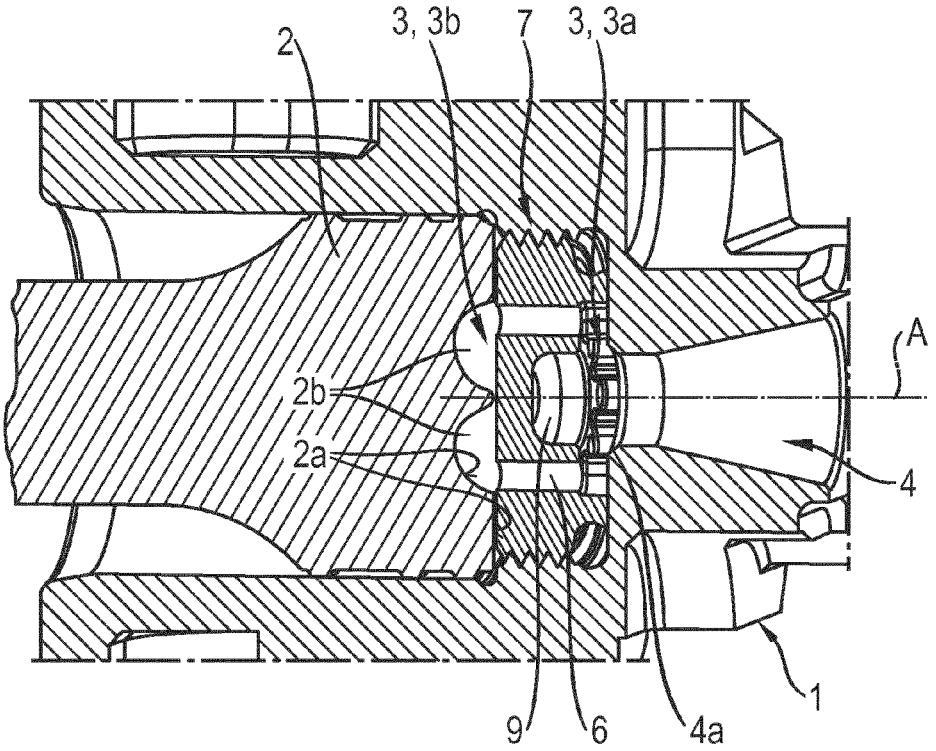
FIG. 1 shows a three-dimensional sectional view of a combustion chamber in a first embodiment of the invention.
Figure 2:
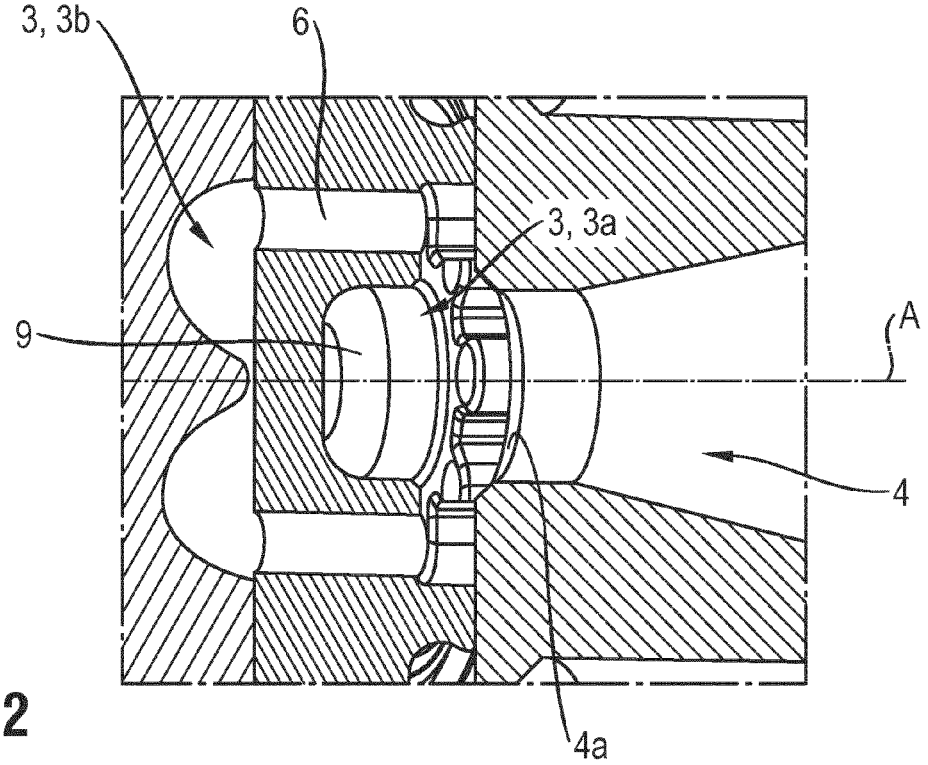
FIG. 2 shows a three-dimensional detail view of the combustion chamber from FIG. 1.
Figure 3:
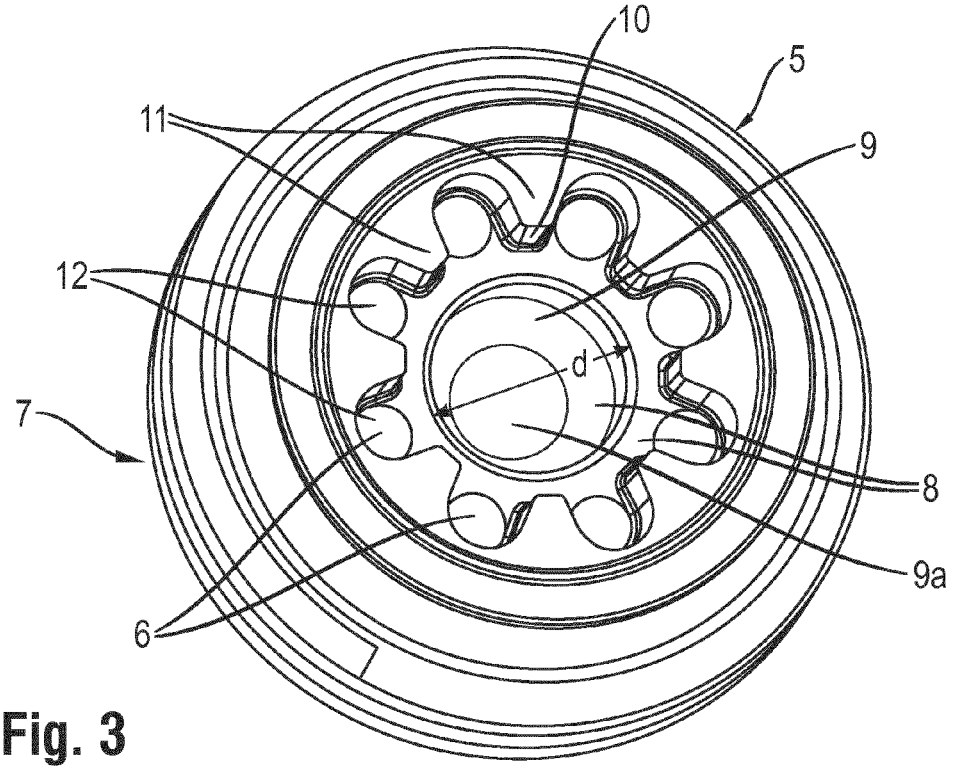
FIG. 3 shows a three-dimensional view of a separating member for the combustion chamber from FIG. 1.

A driving device according to the invention comprises a handheld housing 1, in which an energy transmission element in the form of piston 2 is received. A surface 2*a* of the piston 2 delimits a combustion chamber 3, in which the combustion gases of a pyrotechnic charge expand in order to accelerate the piston 2.

The piston 2 to which kinetic energy is applied in this manner comprises a piston rod with which it strikes a fastening element that is driven into a workpiece thereby.

The charge in the present case is housed in a cartridge made from sheet metal. The cartridge has a percussion igniter and is inserted by a corresponding loading mechanism into a cartridge support 4 before ignition.

The cartridge and the cartridge support are formed rotationally symmetrically about a central axis A. The central axis A in the present example is simultaneously a central axis of the combustion chamber 3 and the piston 2. In embodiments that are not shown, the central axis of the combustion chamber is inclined in relation to the central axis of the piston, more particularly at a right angle thereto.

The combustion chamber 3 is arranged between a circular opening 4*a* of the cartridge support 4 and the surface 2*a* of the piston 2. In the present case, an annular depression 2*b* that contributes to a better turbulence of the combustion gases and constitutes a part of the combustion chamber 3 is formed in the piston 2.

The combustion chamber 3 is subdivided perpendicular to the central axis A by a separating member 5. On the side of the cartridge support 4, there is a first partial chamber 3*a* of the combustion chamber, and there is a second partial chamber 3*b* of the combustion chamber 3 on the side of the piston 2.

In the drawings shown, the piston has been retracted maximally, so that the second partial chamber 3*b* includes only the depression 2*b* and at most a small gap between the piston 2 and the separating member 5 at the time of ignition.

The separating member 5 in the present case is formed as a component that can be screwed into the combustion chamber 3 by means of external thread 7. The separating member can also be integrally formed with the remainder of the combustion chamber, however, or connected to the combustion chamber in some other manner as a separate component.

The separating member 5 has a plurality of perforations 6, which are constructed in the present case as drilled holes that extend parallel to the axis A. The perforations 6 are arranged in the present case about a central region 8 of the separating member 5 that has a contiguous and non-perforated surface. The smallest diameter of the central non-perforated region 8 in a plane perpendicular to the axis A is approximately 35% larger than a diameter of the cartridge opened after the ignition. This corresponds in the present case approximately to the diameter of a combustion chamber-side opening of the cartridge support or a surface of the pyrotechnic charge directed into the combustion chamber.

In the present, idealized, case it is assumed that the combustion gases and the powder grains, charged particles or the like discharged with the gases initially enter the combustion chamber in parallel to the central axis. At least immediately after ignition and over a certain length, the expanding charge therefore moves predominantly in a prismatic discharge region along the central axis, the circumference of which region is defined by the outline of the surface of the charge. In the present embodiments of the invention, all perforations 6 of the separating member lie outside an intersection surface of the discharge region with the surface of the separating member. The discharge region is formed as a cylinder corresponding to the circular cartridge opening.

In addition, a recess 9 is formed in the central region 8 of the separating member 5. The recess 9 runs rotationally symmetrically about the central axis A. It has a bowl-like shape and a flat bottom 9*a*. A diameter of the recess 9 tapers down from a largest diameter d at the upper edge thereof to a smallest diameter at the level of the bottom 9*a*. The walls of the recess 9 have both inclined and straight portions. The maximum depth of the recess 9 in the present case is approximately 60% of the largest diameter d.

In the plane of the upper edge of the recess 9, the contiguous surface of the central region 8 extends up to a gradation 10. The gradation 10 rises from the surface of the central region 8 in the axial direction up to a roof of the combustion chamber 3. The separating member 5 is pressed with the gradation 10 against the roof in the present case. This is achieved by appropriately screwing the separating member 5 into the combustion chamber 3.

The gradation 10 forms respective webs 11, which are directed radially inward, between adjacent perforations 6. Accordingly, radially directed channels 12 remain between the ridges 11, through which channels the combustion gases and charge particles initially flow radially outward from the central region 8 and are then deflected into the perforations 6.

The invention operates as follows:

After ignition of the cartridge, as yet non-combusted particles are forced by a front of combustion gases through the front cartridge opening into the first partial chamber 3*a*. This partially non-combusted charge reaches the bowl-shaped recess 9 of the contiguous central region 8 of the separating member 5 after a short distance. Scattering and turbulence of the powder grains and combustion gases takes place there, in which the powder grains further ignite and burn. This reacting and expanding mixture moves between the webs 11 in a predominately radial direction and is deflected into the perforations 6.

When flowing through the perforations 6, the particles of the charge have already been predominantly combusted, so that large non-combusted charge residues are not present either in the perforations or in the downstream second partial chamber 3*b*. This prevents unfavorable deposits and/or a clogging of the perforations 6. At the same time, a controlled and uniform expansion of the combustion gases in the second partial chamber is favored, so that the piston 2 is optimally accelerated.

Figure 4:
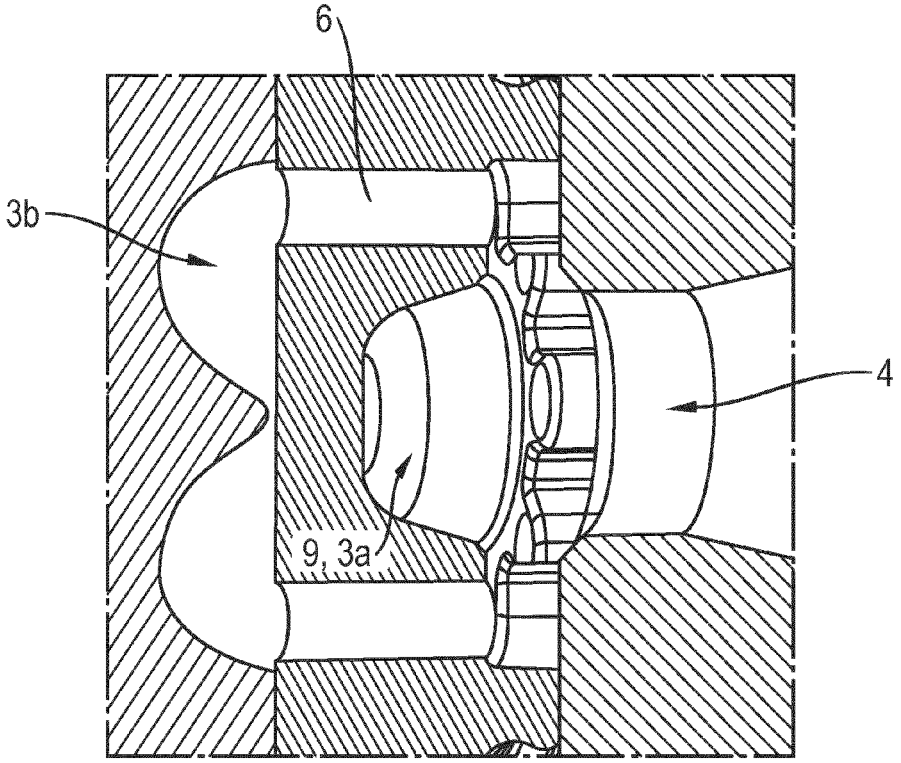
FIG. 4 shows a three-dimensional view of a combustion chamber in a second embodiment of the invention.

A different shaping of the recess 9 is provided in the second embodiment shown in FIG. 4. As in the first example, the recess is formed as a bowl-shaped cutout, but the walls of the recess are more sharply and continuously inclined.

Figure 5:
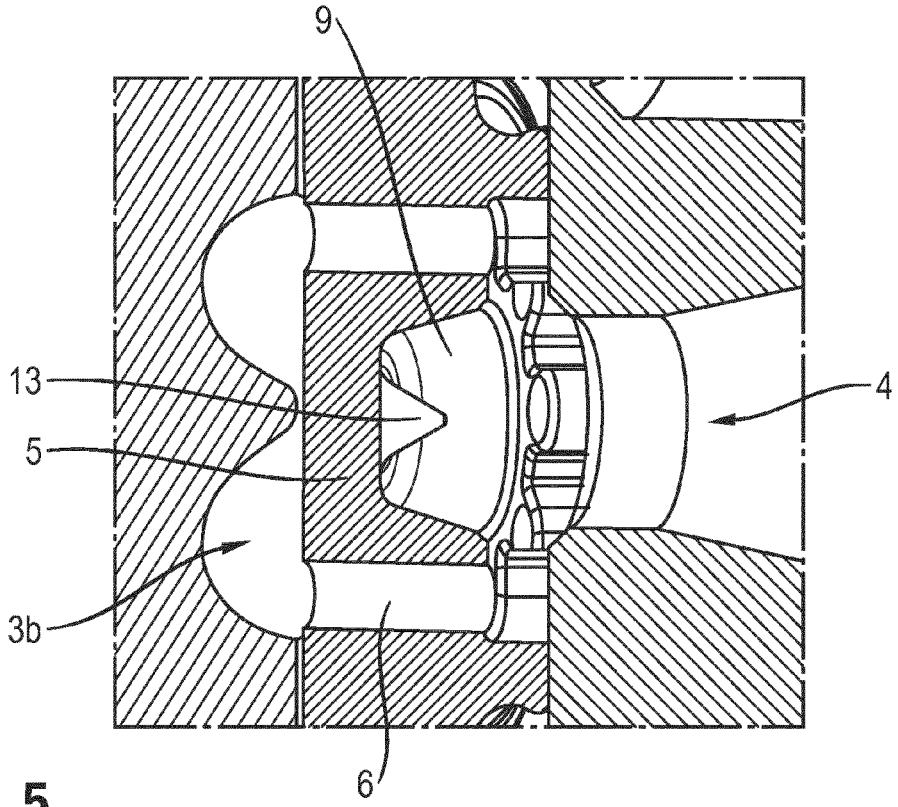
FIG. 5 shows a three-dimensional view of a combustion chamber in a third embodiment of the invention.

In the embodiment shown in FIG. 5, the shaping of the recess 9 is predominantly like that in the example of FIG. 4. In addition, a projecting conical protrusion 13 is formed above the bottom of the recess. The conical protrusion 13 creates a pronounced scattering and turbulence of the combustion gases.

Figure 6:
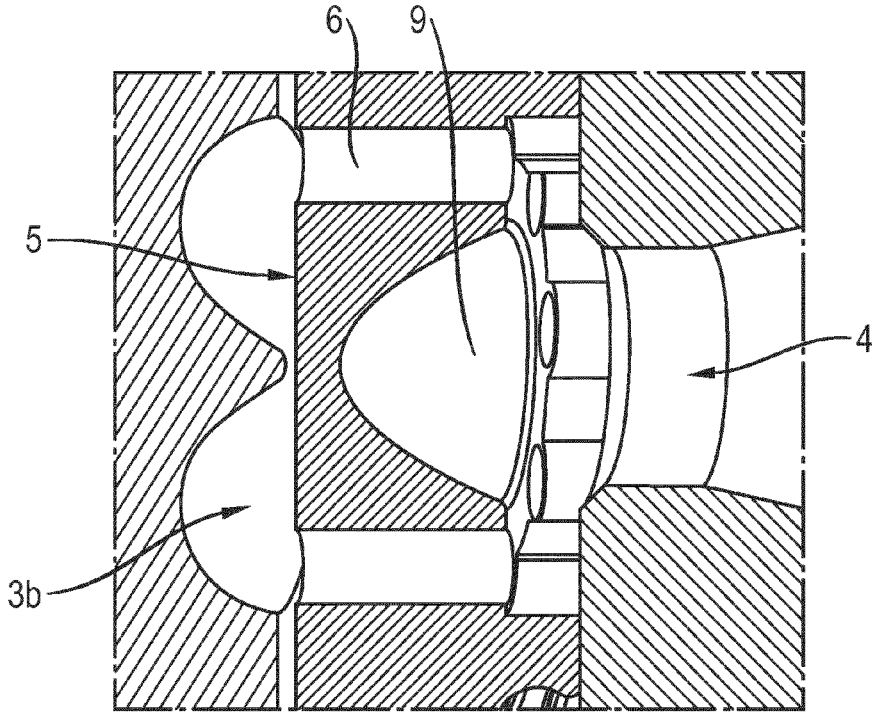
FIG. 6 shows a three-dimensional view of a combustion chamber in a fourth embodiment of the invention.

In the embodiment shown in FIG. 6, the recess 9 does not have a flat bottom, but has an overall approximately parabolic cross section. Such a shape is particularly well suited for avoiding deposits.

It is understood that the invention is not limited to the example shapes of the recess 9 that are shown. In embodiments that are not shown, the separating member has a plurality of recesses. In additional embodiments that are not shown, one or more of the perforations has the recess or recesses. The perforations then preferably comprise blind holes, into each of which one or more connecting channels preferably issue.

The invention claimed is:

1. A driving device, comprising a housing having an energy transmission element arranged therein for transmitting energy to a fastening element to be driven in, a propellant charge, and a combustion chamber arranged between the propellant charge and the energy transmission element, wherein the combustion chamber is subdivided by a separating member having a plurality of perforations into a first partial chamber, which adjoins the propellant charge, and at least one second partial chamber, which adjoins the energy transmission element, wherein the first partial chamber comprises a discharge region for the propellant charge that extends between the propellant charge and a central region of the separating member, and the central region has a recess.

2. The driving device according to claim 1, wherein the discharge region is delimited at the central region of the separating member by an unperforated surface of the separating member.

3. The driving device according to claim 1, wherein the discharge region has no perforations at the central region of the separating member.

4. The driving device according to claim 1, wherein the recess is a bowl-shaped cutout in the separating member.

5. The driving device according to claim 1, comprising a projecting protrusion in a central bottom region of the recess.

6. The driving device according to claim 1, wherein the recess has a diameter that decreases downward from the first partial chamber toward the second partial chamber.

7. The driving device according to claim 1, comprising a central axis, wherein a maximum diameter of the recess extending perpendicular to the central axis is not less than 80% of a maximum diameter of an opening of the propellant charge extending perpendicular to the central axis.

8. The driving device according to claim 1, comprising a central axis, wherein a maximum depth of the recess as measured in the direction of the central axis is not less than 30% of a maximum diameter of the recess measured perpendicular to the central axis.

9. The driving device according to claim 1, comprising at least two adjacent perforations and a web provided between each two adjacent perforations, wherein the combustion gases of the propellant charge initially flow radially outward between the webs from the discharge region before the combustion gases flow in the axial direction through the perforations after deflection.

10. The driving device according to claim 3, wherein the propellant charge comprises particles and the perforations of the separating member have a cross section that is larger than a maximum cross section of particles in the propellant charge.

11. The driving device of claim 1, wherein the propellant charge is an exchangeable propellant charge.

12. The driving device according to claim 2, wherein the recess is a bowl-shaped cutout in the separating member.

13. The driving device according to claim 3, wherein the recess is a bowl-shaped cutout in the separating member.

14. The driving device according to claim 2, comprising a projecting protrusion in a central bottom region of the recess.

15. The driving device according to claim 3, comprising a projecting protrusion in a central bottom region of the recess.

16. The driving device according to claim 4, comprising a projecting protrusion in a central bottom region of the recess.

17. The driving device according to claim 2, wherein the recess has a diameter that decreases downward from the first partial chamber toward the second partial chamber.

18. The driving device according to claim 3, wherein the recess has a diameter that decreases downward from the first partial chamber toward the second partial chamber.

19. The driving device according to claim 4, wherein the recess has a diameter that decreases downward from the first partial chamber toward the second partial chamber.

20. The driving device according to claim 5, wherein the recess has a diameter that decreases downward from the first partial chamber toward the second partial chamber.

* * * * *